US007377861B2

(12) United States Patent
Tateno et al.

(10) Patent No.: US 7,377,861 B2
(45) Date of Patent: May 27, 2008

(54) GOLF CLUB HEAD

(75) Inventors: Atsuo Tateno, Tokyo (JP); Hideo Matsunaga, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 168 days.

(21) Appl. No.: 11/312,542

(22) Filed: Dec. 21, 2005

(65) Prior Publication Data

US 2007/0049405 A1 Mar. 1, 2007

(30) Foreign Application Priority Data

Aug. 23, 2005 (JP) ..... P2005-241753

(51) Int. Cl.
*A63B 53/00* (2006.01)

(52) U.S. Cl. ..... 473/345; 473/349

(58) Field of Classification Search ..... 473/345, 473/329, 324, 346, 349; *A63B 53/04*
See application file for complete search history.

(56) References Cited

U.S. PATENT DOCUMENTS

| | | | | |
|---|---|---|---|---|
| 3,556,533 | A * | 1/1971 | Hollis | 473/338 |
| 6,048,278 | A | 4/2000 | Meyer et al. | |
| 6,348,013 | B1 * | 2/2002 | Kosmatka | 473/329 |
| 6,524,194 | B2 | 2/2003 | McCabe | |
| 6,602,149 | B1 * | 8/2003 | Jacobson | 473/329 |
| 6,679,786 | B2 * | 1/2004 | McCabe | 473/305 |
| 6,949,031 | B2 * | 9/2005 | Imamoto et al. | 473/329 |
| 2005/0124436 | A1 * | 6/2005 | Kakiuchi et al. | 473/345 |

FOREIGN PATENT DOCUMENTS

| | | | |
|---|---|---|---|
| JP | 07-284546 | A | 10/1995 |
| JP | 11-155982 | A | 6/1999 |
| JP | 2000126339 | A * | 5/2000 |
| JP | 2000-300701 | A | 10/2000 |
| JP | 2003-52866 | A | 2/2003 |
| JP | 2003-79768 | A | 3/2003 |
| JP | 2003-88601 | A | 3/2003 |
| JP | 2004041376 | A * | 2/2004 |
| JP | 2005-137788 | A | 6/2005 |

OTHER PUBLICATIONS

Jackson, Jeff, The Modern Guide to Golf Clubmaking, Dynacraft Golf Products, Inc, 1994, p. 238.

* cited by examiner

*Primary Examiner*—Joe H. Cheng
*Assistant Examiner*—Michael D Dennis
(74) *Attorney, Agent, or Firm*—Sughrue Mion, PLLC

(57) ABSTRACT

A hollow golf club head includes a face part, a crown part, a sole part, a side part, and a hosel part. The head has a volume of 100 to 250 $cm^3$ and a weight of 195 to 250 g. The crown part includes a large-thickness crown part formed along an overall edge thereof, and a small-thickness crown part which is formed inside the large-thickness crown part and has a thickness less than a thickness of the large-thickness crown part. The side part includes a heel-side small-thickness side part formed at a heel side, a toe-side small-thickness side part formed at a toe side, and a large-thickness side part which is formed at a portion of the side part other than the heel-side small-thickness side part and the toe-side small-thickness side part and has a thickness greater than thickness of the side parts.

20 Claims, 4 Drawing Sheets

GOLF CLUB HEAD

BACKGROUND OF THE INVENTION

1. Field of the Invention

The present invention relates to a hollow golf club head that is capable of increasing the launch angle of a hit ball and increasing the distance of the hit ball.

2. Description of the Related Art

Recently, there have been proposed hollow golf club heads constructed such that elastic deformation is generated at a crown part as well as a face part when hitting a ball, whereby the launch angle and distance of the hit ball are increased. Examples of such hollow golf club heads are disclosed in JP-A-2003-52866, JP-A-2003-79768, JP-A-2003-88601 and JP-A-2005-137788.

The golf club head disclosed in JP-A-2003-52866 is a metal hollow golf club head comprising a face part, a sole part, a side part, a crown part, and a hosel part, wherein at least the main portions of the crown part and the face part are integrally formed with each other, by casting, to constitute a front part, the other parts of the golf club head excluding the front part are also integrally formed with each other to constitute a back part, and the front part and the back part are joined to each other.

The golf club head disclosed in JP-A-2003-79768 is a metal hollow golf club head comprising at least a face part, a sole part, a side part, and a crown part, wherein the metal material forming the crown part has the lowest modulus of longitudinal elasticity.

The golf club head disclosed in JP-A-2003-88601 is a metal hollow golf club head comprising a face part, a sole part, a toe-side side part, a heel-side side part, back-side side part, a crown part, and a hosel part, wherein the crown part is provided with a plurality of grooves, which extend from the toe-side side part toward the heel-side side part.

The golf club head disclosed in JP-A-2005-137788 is a hollow golf club head comprising a face part having a face surface, by which a ball is hit, and a head body part extending to the rear of the head along the rear surface of the face part, wherein the head body part includes a crown part, a sole part, and a side part, which form an upper head part, a lower head part, and a side head part, respectively, and the crown part includes a front crown part forming a front section extending a distance corresponding to 0.15 of the crown depth-wise length Lc from the rear surface of the face part and a rear crown part forming a rear section extending 0.30 or more, moreover, 1.0 of the crown depth-wise length Lc from the rear surface of the face part, the front crown part having a rigidity smaller than that of the rear crown part.

However, it is required that the golf club heads according to JP-A-2003-52866, JP-A-2003-79768, JP-A-2003-88601, and JP-A-2005-137788 be improved to increase launch angle.

SUMMARY OF THE INVENTION

The present invention provides a hollow golf club head that is capable of increasing the launch angle of a hit ball and increasing the distance of the hit ball.

The inventor has performed careful research to accomplish the above-stated object, and found that partially increasing or decreasing the thicknesses of the components of the golf club head such that the center of the golf club head is located at the optimal position, and, in addition, decreasing the rigidity of the crown part, increasing the rigidity of the sole part, and decreasing the rigidity of the side part are effective in increasing the launch angle of a hit ball, and therefore, increasing the distance of the hit ball.

According to an aspect of the present invention, a hollow golf club head includes a face part, a crown part, a sole part, a side part, and a hosel part. The head has a volume of 100 to 250 $cm^3$ and a weight of 195 to 250 g. The crown part includes a large-thickness crown part formed along an overall edge thereof, and a small-thickness crown part which is formed inside the large-thickness crown part and has a thickness less than a thickness of the large-thickness crown part. The side part includes a heel-side small-thickness side part formed at a heel side, a toe-side small-thickness side part formed at a toe side, and a large-thickness side part which is formed at a portion of the side part other than the heel-side small-thickness side part and the toe-side small-thickness side part and has a thickness greater than thickness of the heel-side small-thickness side part and the toe-side small-thickness side part.

DETAILED DESCRIPTION OF THE INVENTION

Figure 1:
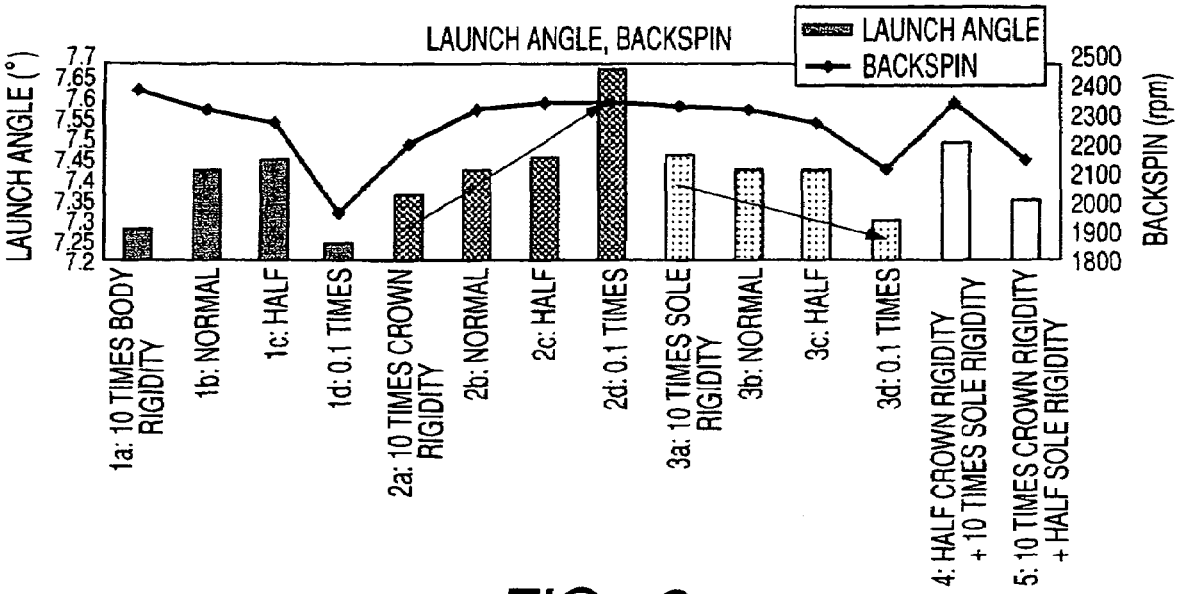
FIG. 1 is a graph illustrating changes in the launch angle and the amount of backspin of a hit ball when changing the body rigidity, crown rigidity, and sole rigidity of a golf club head.

A preferred embodiment of the present invention will be described in detail with reference to the accompanying drawings. According to the present invention, a sole part of a golf club head is a part extending from the lower part of a face part to the rear of the face part to form the lower part of the head, a crown part of the golf club head is a part extending from the upper part of the face part to the rear of the face part to form the upper part of the head, and a side part of the golf club head is a part extending from between the upper and lower parts of the face part to the rear of the face part to form the side part of the head. The side part includes a toe-side side part, heel-side side part, and a back-side side part.

According to the present invention, it is preferable that the thickness of a large-thickness crown part be 0.65 to 5.0 mm, especially, 0.7 to 2.0 mm, the thickness of a small-thickness crown part be 0.1 to 0.65 mm, especially, 0.3 to 0.6 mm, the thickness of a heel-side small-thickness side part be 0.1 to 0.65 mm, especially, 0.3 to 0.6 mm, the thickness of a toe-side small-thickness side part be 0.1 to 0.65 mm, especially, 0.3 to 0.6 mm, and the thickness of a large-thickness side part be 0.65 to 5.0 mm, especially, 0.7 to 2.0 mm. When the thicknesses of the respective parts go beyond the above-specified ranges, sufficient launch angle of a hit ball may not be obtained.

Also, it is appropriate that the distance of the large-thickness crown part in the face to back direction be 4 to 30% of the distance of the crown part in the face to back direction, the distance of the small-thickness crown part in the face to back direction be 40 to 92% of the distance of the crown part in the face to back direction, the distance of the heel-side small-thickness side part in the face to back direction be 4 to 92% of the distance of the crown part in the face to back direction, and the distance of the toe-side small-thickness side part in the face to back direction be 4 to 92% of the distance of the crown part in the face to back direction. When the distances of the respective parts go beyond the above-specified ranges, sufficient launch angle of a hit ball may not be obtained.

In the golf club head according to the present invention, it is preferable that the sole part include a face-side large-thickness sole part formed at the face side and a small-thickness sole part formed adjacent to the back-side end of the face-side large-thickness sole part and having a thickness less than that of the face-side large-thickness sole part, whereby a greater launch angle of a hit ball is obtained.

In the golf club head according to the present invention, it is also preferable that the sole part include a back-side large-thickness sole part formed at the back side and a small-thickness sole part formed adjacent to the face-side end of the back-side large-thickness sole part and having a thickness less than that of the back-side large-thickness sole part, whereby a greater launch angle of a hit ball is obtained owing to a lower gravity center and a deeper gravity center.

It is preferable that the thickness of the face-side large-thickness sole part be 0.7 to 10.0 mm, especially, 1.0 to 5.0 mm, the thickness of the back-side large-thickness sole part be 0.7 to 10.0 mm, especially, 1.0 to 5.0 mm, and the thickness of the small-thickness sole part be 0.3 to 2.0 mm, especially, 0.5 to 1.5 mm.

Also, it is appropriate that the distance of the face-side large-thickness sole part in the face to back direction be 4 to 30% of the distance of the sole part in the face to back direction, the distance of the back-side large-thickness sole part in the face to back direction be 4 to 66% of the distance of the sole part in the face to back direction, and the distance of the small-thickness sole part in the face to back direction be 4 to 92% of the distance of the sole part in the face to back direction.

In the golf club head according to the present invention, it is preferable that the side part further include a weighted large-thickness side part formed at the back side of the large-thickness side part and having a thickness greater than those of the other portions of the large-thickness side part, whereby the center of the golf club head is located at the optimal position.

It is preferable that the thickness of the weighted large-thickness side part be 0.7 to 10.0 mm, especially, 1.0 to 5.0 mm. Also, it is appropriate that the distance of the weighted large-thickness side part in the heel to toe direction be 3 to 80% of the distance of the crown part in the heel to toe direction.

According to the present invention, it is possible to attach one or more screws, which are made of a material having specific gravity different from that of the sole part, to an appropriate position or appropriate positions of the sole part. Also, it is possible to attach one or more screws, which are made of a material having specific gravity different from that of the side part, to an appropriate position or appropriate positions of the side part. It is possible to further adjust the center of the golf club head to the optimal position through the use of the above-mentioned screws. In this case, it is preferable that the weight of each screw be 0.5 to 50 g.

In the golf club according to the present invention, it is preferable that the rigidity of the sole part be greater than that of the crown part, whereby a greater launch angle of a hit ball is obtained. Specifically, it is appropriate that the ratio of the rigidity of the sole part to the rigidity of the crown part be 1:0.1 to 0.8, especially, 0.2 to 0.6.

In this case, the rigidity is a value obtained by the following equation (1).

$$\text{Rigidity(unit: MPa·mm}^4\text{)}=E\times I \quad (1)$$

E: Young's modulus (unit: MPa)

I: Moment of inertia of area (unit: $mm^4$)

The Young's modulus E is dependent on the materials of the components of the golf club head, and the moment of inertia of area I is dependent on thicknesses of the components of the golf club head. When the thicknesses of the components are the same, the ratio of the rigidity is decided by the ratio of the components of Young's modulus E. When the thicknesses of the components are not the same, on the other hand, the ratio of the rigidity is decided by the third power of the ratio of the thickness.

In the golf club according to the present invention, it is also preferable that the rigidity of the sole part be greater than that of the side part, whereby a greater launch angle of a hit ball is obtained. Specifically, it is appropriate that the ratio of the rigidity of the sole part to the rigidity of the side part be 1:0.1 to 0.8, especially, 0.2 to 0.6.

Although a method of manufacturing the golf club head according to the present invention is not restricted, for example, it is preferable to manufacture the golf club head by blocking a face opening part of the head body with a face member. In this case, although the material of the head body and the method of forming the head body are not restricted, it is possible to use titanium, titanium alloy, stainless steel, and amorphous alloys as the material of the head body and to form the head body by using a casting method. According to the present invention, it is preferable that at least the crown part and the side part of the head body be manufactured by a casting method because the crown part and the side part of the head body have large-thickness parts and small-thickness parts, and therefore, the shape of the head body is complicated. Also, it is preferable to manufacture even the sole part by the casting method in the case that the sole part includes a large-thickness part and a small-thickness part. Although the material of the face member and the method of forming the face member are not particularly restricted, it is possible to use titanium, titanium alloy, stainless steel, and amorphous alloys as the material of the head body, and it is appropriate to form the face member by using a forging method, a press-forming method of pressing boards or planks, or a die casting method. According to the present invention, it is possible that the face member is a member including a section having the maximum thickness at the center thereof and an incline part formed at the outside of the section having the maximum-thickness, the thickness of the incline part being gradually decreased.

Also, although the method of joining the head body and the face member is not restricted, it is preferable to join the head body and the face member by plasma welding, laser welding, or electron beam welding, whereby joined points are clearly finished, and accuracy in weight of the golf club head is increased. It is most preferable to join the head body and the face member by plasma welding. In this case, it is possible to use a well-known plasma welding method that performs welding by melting a material to be welded using high-temperature energy generated by plasma arc, and solidifying the melted material. In the case of the laser welding, a well-known laser welding method using gas laser, such as CO laser or $CO_2$ laser, or solid laser, such as YAG laser, may be used. In the case of the electron beam welding, a well-known electron beam welding method using electron beams having appropriate output may be used.

In the golf club head according to the present invention, the head has a volume of 100 to 250 $cm^3$, and the head has a weight of 195 to 250 g. The golf club head according to the present invention is mainly used as a golf club head for fairway wood.

The hollow golf club head according to the present invention has the effect of increasing the launch angle of a hit ball, and therefore, increasing the distance of the hit ball.

EXPERIMENTAL EXAMPLE

Hereinafter, an experimental example demonstrating the above-stated effect of the present invention will be illustrated. FIG. 1 is a graph illustrating changes in the launch angle and the amount of backspin of a hit ball when changing the rigidity of the entire golf club head (body rigidity), the rigidity of the crown part (crown rigidity), and the rigidity of the sole part (sole rigidity). As shown in FIG. 1, the body rigidity of sample number 1*a* was 10 times the normal body rigidity, the body rigidity of sample number 1*b* was equal to the normal body rigidity (1×), the body rigidity of sample number 1*c* was half the normal body rigidity, and the body rigidity of sample number 1*d* was 0.1 times the normal body rigidity. The crown rigidity of sample number 2*a* was 10 times the normal crown rigidity, the crown rigidity of sample number 2*b* was equal to the normal crown rigidity (1×), the crown rigidity of sample number 2*c* was half the normal crown rigidity, and the crown rigidity of sample number 2*d* was 0.1 times the normal crown rigidity. The sole rigidity of sample number 3*a* was 10 times the normal sole rigidity, the sole rigidity of sample number 3*b* was equal to the normal sole rigidity (1×), the sole rigidity of sample number 3*c* was half the normal sole rigidity, and the sole rigidity of sample number 3*d* was 0.1 times the normal sole rigidity. The crown rigidity of sample number 4 was half the normal crown rigidity while the sole rigidity of sample number 4 was 10 times the normal sole rigidity, and the crown rigidity of sample number 5 was 10 times the normal crown rigidity while the sole rigidity of sample number 4 was half the normal sole rigidity. As can be seen from the results of FIG. 1, the launch angle of the hit ball was increased when the rigidity of the crown part was low, and the rigidity of the sole part was high.

Figure 2:
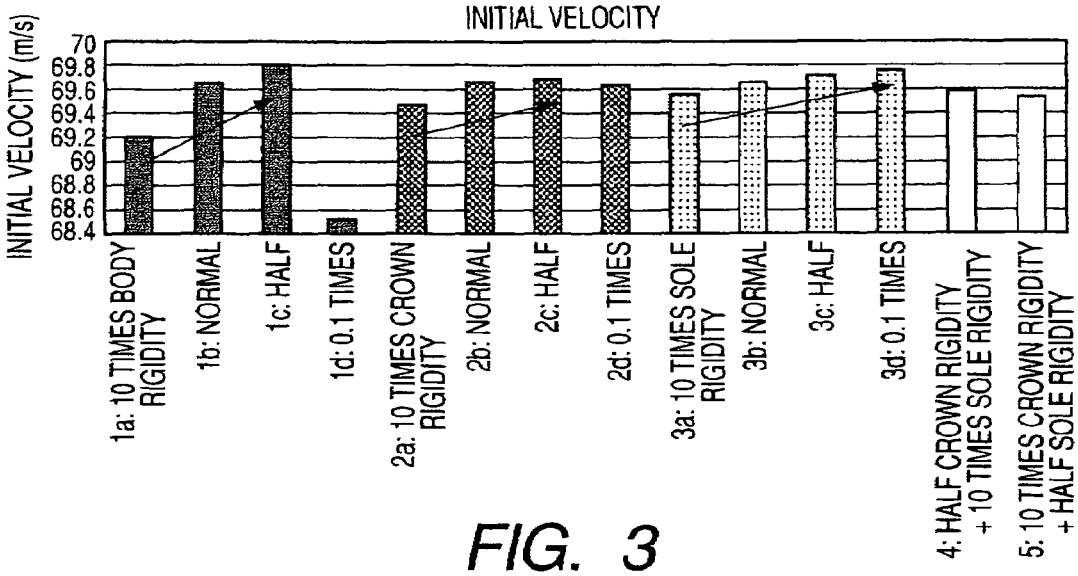
FIG. 2 is a graph illustrating changes in the initial velocity of a hit ball when changing the body rigidity, crown rigidity, and sole rigidity of a golf club head.

FIG. 2 is a graph illustrating changes in the initial velocity of a hit ball when changing the body rigidity, crown rigidity, and sole rigidity of a golf club head. The graph of FIG. 2 is given for comparison with the present invention that increases the launch angle of the hit ball. As shown in FIG. 2, sample numbers 1*a* to 1*d*, 2*a* to 2*d*, 3*a* to 3*d*, 4 and 5 were the same as those of FIG. 1. As can be seen from the results of FIG. 2, the initial velocity of the hit ball was increased when the rigidity of the crown part was low, and the rigidity of the sole part was also low.

Figure 3:
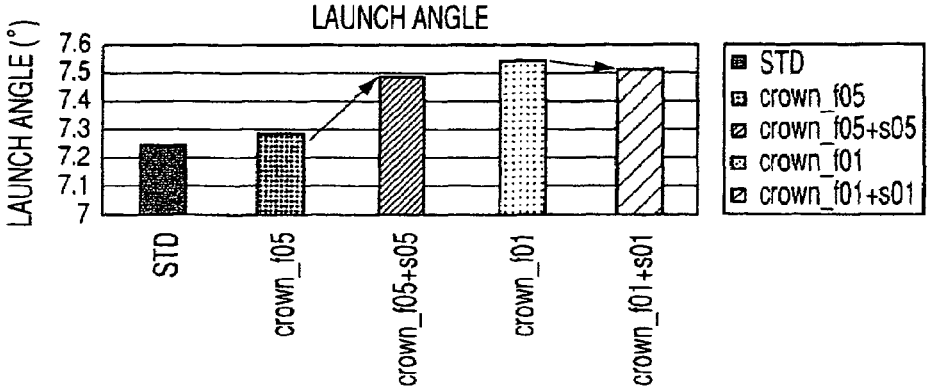
FIG. 3 is a graph illustrating changes in the launch angle of a hit ball when partially changing the rigidity of a crown part of a golf club head and, at the same time, reducing the rigidity of a side part of the golf club head.
Figure 4:
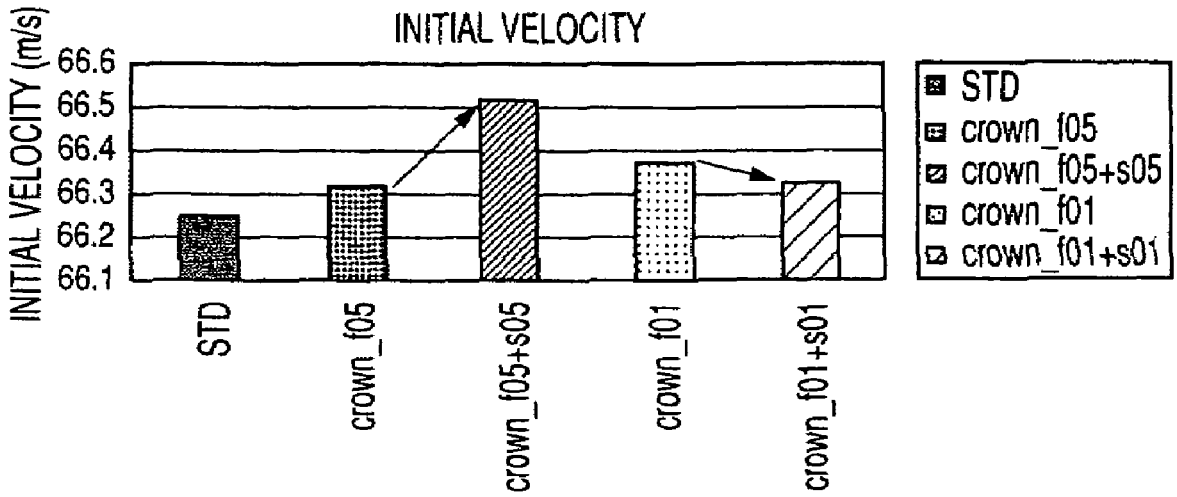
FIG. 4 is a view illustrating sections of a crown part.

FIG. 3 is a graph illustrating changes in the launch angle of a hit ball when partially changing the rigidity of a crown part of a golf club head from a standard (STD) titanium material and, at the same time, reducing the rigidity of a side part of the golf club head. Sample numbers of FIG. 3 indicate samples described in the following Table 1. The rigidity of each sample was set for sections (1), (2), and (3) of the crown part shown in FIG. 4 and the side part as indicated in Table 1. As can be seen from the results of FIG. 3, the launch angle of the hit ball was increased when the rigidity of the side part was low to some extent, but the launch angle of the hit ball was not increased when the rigidity of the side part was too low.

TABLE 1

| | Magnifying power of rigidity for sections (times) (versus titanium ratio) | | | |
|---|---|---|---|---|
| Samples | Section (1) | Section (2) | Section (3) | Side part |
| STD | 1 | 1 | 1 | 1 |
| crown_f05 | 0.5 | 0.5 | 1 | 1 |
| crown_f05_s05 | 0.5 | 0.5 | 1 | 0.5 |
| crown_f01 | 0.1 | 0.1 | 1 | 1 |
| crown_f01_s01 | 0.1 | 0.1 | 1 | 0.1 |

Figure 5:
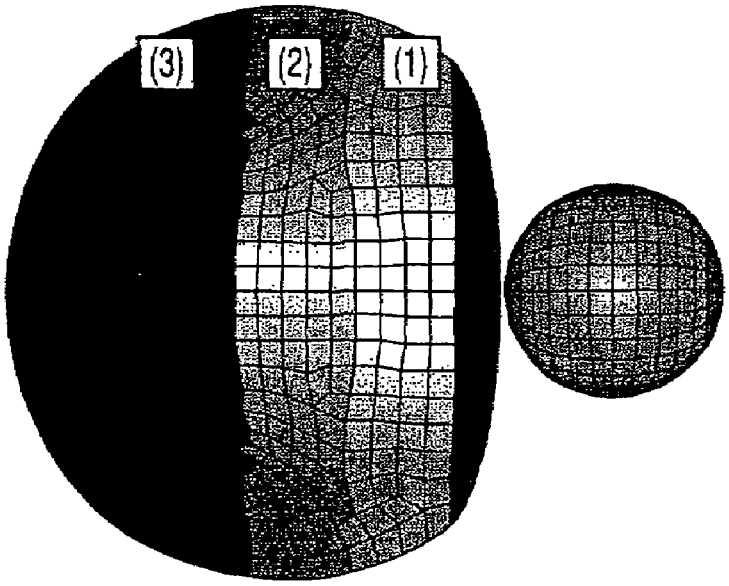
FIG. 5 is a graph illustrating changes in the initial velocity of a hit ball when partially changing the rigidity of a crown part of a golf club head and, at the same time, reducing the rigidity of a side part of the golf club head.

FIG. 5 is a graph illustrating changes in the initial velocity of a hit ball when partially changing the rigidity of a crown part of a golf club head and, at the same time, reducing the rigidity of a side part of the golf club head. Sample numbers of FIG. 5 indicate samples described in the above Table 1. As can be seen from the results of FIG. 5, the launch angle of the hit ball was increased when the rigidity of the side part was low to some extent, but the launch angle of the hit ball was not increased when the rigidity of the side part was too low, in the same manner as the above-mentioned launch angle.

EMBODIMENT

Figure 6:
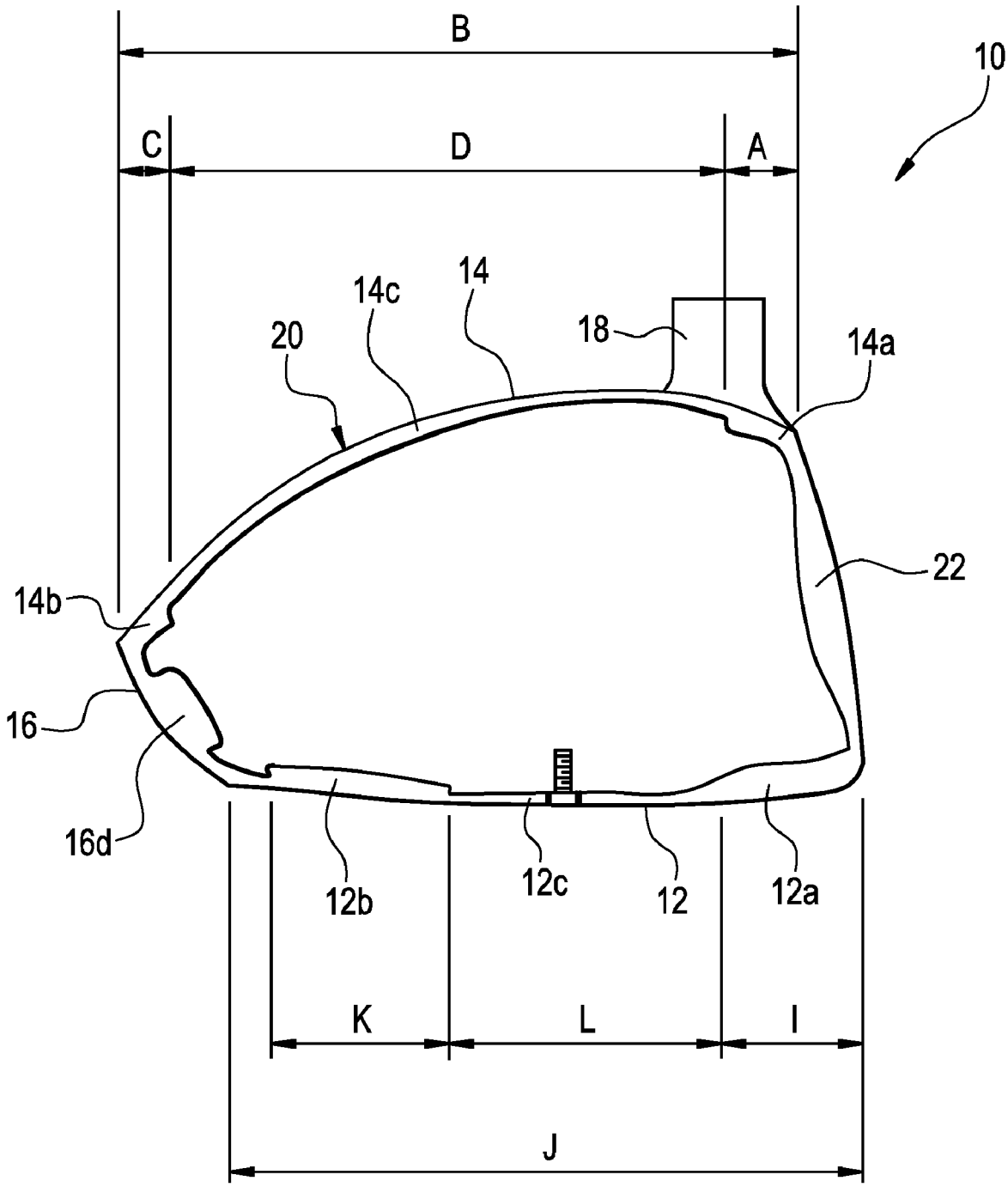
FIG. 6 is a vertical sectional view of the golf club head according to the preferred embodiment of the present invention.
Figure 7:
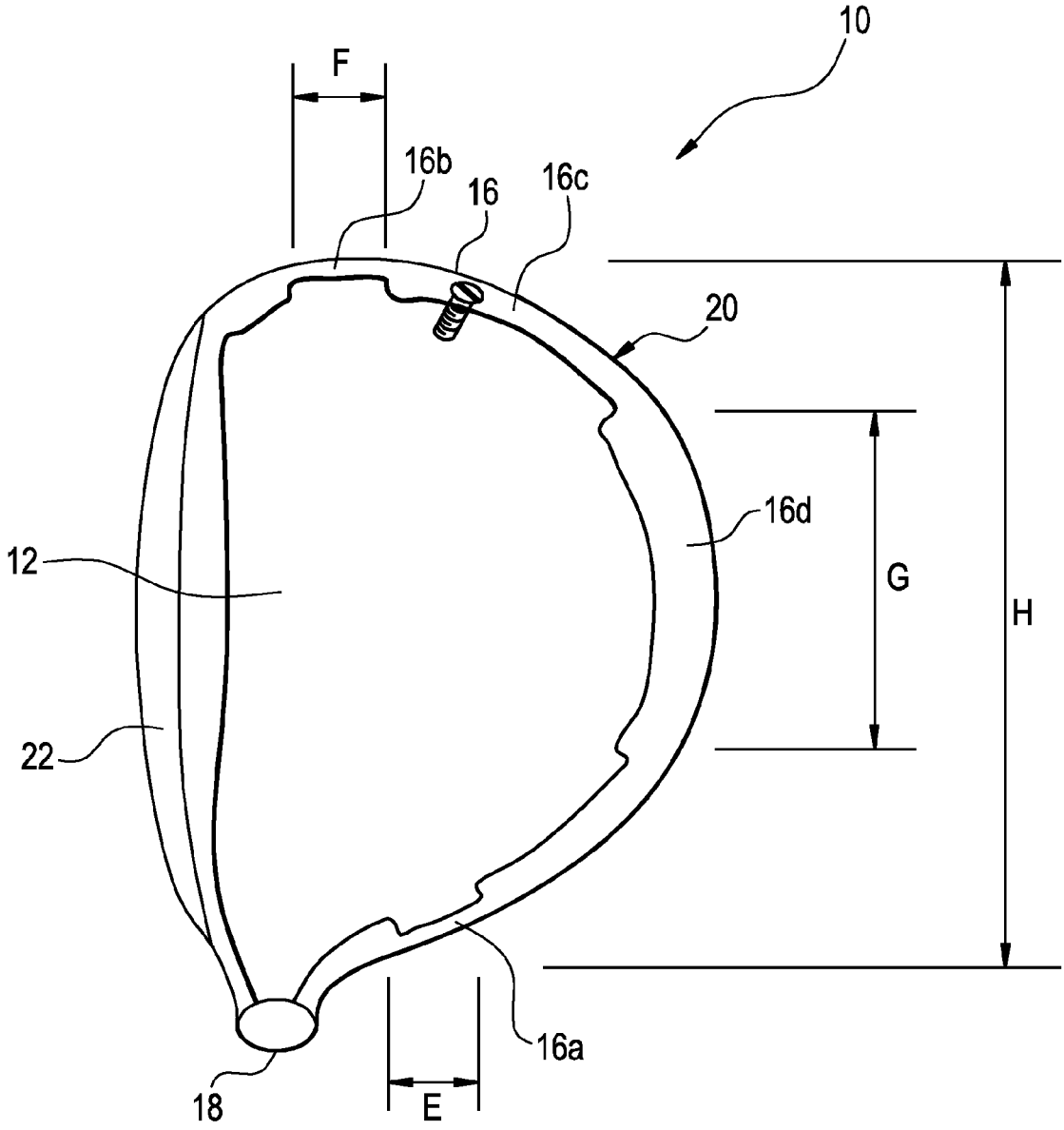
FIG. 7 is a cross-sectional view of the golf club head according to the preferred embodiment of the present invention.
Figure 8:
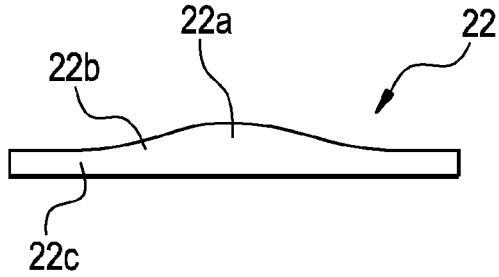
FIG. 8 is a cross-sectional view of a face member of the golf club head according to the preferred embodiment of the present invention.

A preferred embodiment of the present invention will be described in detail with reference to the accompanying drawings. It should be noted, however, that the present invention is not limited to the illustrated embodiment. FIG. 6 is a vertical sectional view of the golf club head according to the preferred embodiment of the present invention, FIG. 7 is a cross-sectional view of the golf club head according to the preferred embodiment of the present invention, and FIG. 8 is a cross-sectional view of a face member of the golf club head according to the preferred embodiment of the present invention.

The golf club head 10 according to this embodiment comprises: a head body 20 including a sole part 12, a crown part 14, a side part 16, and a hosel part 18; and a face member 22 fixedly attached to a face opening part of the head body 20 by plasma welding. The material of the head body 20 is stainless steel (SUS630), the material of the face member 22 is 15-5 stainless steel (15Cr-5Ni-3Cu—Nb—Fe). Also, the golf club head 10 according to this embodiment is a golf club head for fairway wood, the volume of which is approximately 140 to 170 $cm^3$ and the weight of which is approximately 205 to 225 g.

In the golf club head 10 according to this embodiment, the crown part 14 includes ring-shaped large-thickness crown parts 14*a* and 14*b* formed along the overall edge thereof and a small-thickness crown part 14*c* formed inside the large-thickness crown parts 14*a* and 14*b* and having a thickness less than those of the large-thickness crown parts 14*a* and 14*b*. In the illustrated embodiment, the large-thickness crown part disposed at the face side is referred to as a face-side large-thickness crown part 14*a*, and the large-thickness crown part disposed at the back side is referred to as a back-side large-thickness crown part 14*b*.

The side part 16 includes a heel-side small-thickness side part 16*a* formed at the heel side, a toe-side small-thickness side part 16*b* formed at the toe side, and a large-thickness side part 16*c* formed at the other portions of the side part excluding the heel-side small-thickness side part 16*a* and the toe-side small-thickness side part 16*b* and having a thickness greater than those of the heel-side small-thickness side part 16*a* and the toe-side small-thickness side part 16*b*. The side part 16 further includes a weighted large-thickness side part 16*d* formed at the back side of the large-thickness side part 16*c* and having a thickness greater than those of the other portions of the large-thickness side part 16*c*.

The sole part 12 includes a face-side large-thickness sole part 12*a* formed at the face side, a back-side large-thickness sole part 12*b* formed at the back side, and a small-thickness sole part 12*c* formed at the other portions of the sole part excluding the face-side large-thickness sole part 12*a* and the back-side large-thickness sole part 12*b* and having a thickness less than those of the face-side large-thickness sole part 12*a* and the back-side large-thickness sole part 12*b*.

In the golf club head according to this embodiment, the thickness of the face-side large-thickness crown part 14*a* is 0.8 mm, the thickness of the back-side large-thickness crown part 14*b* is 0.8 mm, the thickness of the small-thickness crown part 14*c* is 0.55 mm, the thickness of the heel-side small-thickness side part 16*a* is 0.55 mm, the thickness of the toe-side small-thickness side part 16*b* is 0.55 mm, the thickness of the large-thickness side part 16*c* is 0.7 mm, the thickness of the weighted large-thickness side part 16*d* is 2.0 mm, the thickness of the face-side large-thickness sole part 12*a* is 1.2 mm, the thickness of the back-side large-thickness sole part 12*b* is 2.0 mm, and the thickness of the small-thickness sole part 12*c* is 1.0 mm.

Also, the distance A of the face-side large-thickness crown part 14*a* in the face to back direction is 10% of the distance B of the crown part 14 in the face to back direction, the distance C of the back-side large-thickness crown part 14*b* in the face to back direction is 8% of the distance B of the crown part 14 in the face to back direction, the distance D of the small-thickness crown part 14*c* in the face to back direction is 82% of the distance B of the crown part 14 in the face to back direction, the distance E of the heel-side small-thickness side part 16*a* in the face to back direction is 28% of the distance B of the crown part 14 in the face to back direction, the distance F of the toe-side small-thickness side part 16*b* in the face to back direction is 48% of the distance B of the crown part 14 in the face to back direction, the distance G of the weighted large-thickness side part 16*d* in the heel to toe direction is 70% of the distance H of the crown part 14 in the heel to toe direction, the distance I of the face-side large-thickness sole part 12*a* in the face to back direction is 18% of the distance J of the sole part 12 in the face to back direction, the distance K of the back-side large-thickness sole part 12*b* in the face to back direction is 45% of the distance J of the sole part 12 in the face to back direction, and the distance L of the small-thickness sole part 12*c* in the face to back direction is 27 to 37% of the distance J of the sole part 12 in the face to back direction.

Also, as shown in FIG. 8, the face member 22 of the golf club head 10 according to this embodiment includes a section 22*a* having the maximum thickness (2.7 mm) at the center thereof and formed in the shape of an ellipse when is seen from the front thereof, an incline part 22*b* positioned at the outside of the section 22*a* such that the thickness of the incline part is gradually decreased and formed in the shape of an ellipse when is seen from the front thereof, and a section 22*c* formed at the outside of the incline part 22*b* and having the minimum thickness (approximately 1.9 mm).

In the golf club head 10 according to this embodiment, the ratio of the rigidity of the sole part 12 to the rigidity of the crown part 14 is 1:0.4, and the ratio of the rigidity of the sole part 12 to the rigidity of the side part 16 is 1:0.4.

Furthermore, in the gold club head 10 according to this embodiment, it is possible to attach one or more screws, which are made of a material having specific gravity different from that of the sole part 12 or the side part 16 (for example, tungsten), to an appropriate position or appropriate positions of the sole part 12 or the side part 16.

What is claimed is:

1. A hollow golf club head comprising:

a face part;

a crown part;

a sole part;

a side part; and a hosel part, wherein the head has a volume of 100 to 250 cm3, and the head has a weight of 195 to 250 g, wherein the crown part includes:

a large-thickness crown part formed along an overall edge thereof; and a small-thickness crown part which is formed inside the large-thickness crown part and has a thickness less than a thickness of the large-thickness crown part, wherein the side part includes:

a heel-side small-thickness side part formed at a heel side;

a toe-side small-thickness side part formed at a toe side; and a large-thickness side part which is formed at a portion of the side part other than the heel-side small-thickness side part and the toe-side small-thickness side part and has a thickness greater than the thickness of the heel-side small-thickness side part and the toe-side small-thickness side part, wherein a length of the large-thickness crown part, in a face to back direction is 4% to 30% of a length of the crown part in the face to back direction;

wherein a length of the small-thickness crown part in the face to back direction is 40% to 92% of the length of the crown part in the face to back direction; and wherein the large-thickness crown part connects to a rear surface of the face part in a continuous manner.

2. The golf club head according to claim 1, wherein the large-thickness crown part has a thickness of 0.65 to 5.0 mm, and wherein the small-thickness crown part has a thickness of 0.1 to 0.65 mm.

3. The golf club head according to claim 1, wherein the heel-side small-thickness side part has a thickness of 0.1 to 0.65 mm, wherein the toe-side small-thickness side part has a thickness of 0.1 to 0.65 mm, and wherein the large-thickness side part has a thickness of 0.65 to 5.0 mm.

4. The golf club head according to claim 1, wherein the sole part includes:

a face-side large-thickness sole part formed at a face side; and a small-thickness sole part which is formed adjacent to a back-side end of the face-side large-thickness sole part and has a thickness less than a thickness of the face-side large-thickness sole part.

5. The golf club head according to claim 4, wherein the face-side large-thickness sole part has a thickness of 0.7 to 10.0 mm.

6. The golf club head according to claim 1, wherein the sole part includes:

a back-side large-thickness sole part formed at a back side; and a small-thickness sole part which is formed adjacent to a face-side end of the back-side large-thickness sole part and has a thickness less than a thickness of the back-side large-thickness sole part.

7. The golf club head according to claim 6, wherein the back-side large-thickness sole part has a thickness of 0.7 to 10.0 mm.

8. The golf club head according to claim 1, wherein the side part further includes:

a weighted large-thickness side part which is formed at a back side of the large-thickness side part and has a thickness greater than a thickness of an other portion of the large-thickness side part.

9. The golf club head according to claim 8, wherein the weighted large-thickness side part has a thickness of 0.65 to 10.0 mm.

10. The golf club head according to claim 1, further comprising:

one or more screws attached to the sole part, the screws being made of a material having specific gravity different from a specific gravity of a material of the sole part.

11. The golf club head according to claim 10, wherein the screw has a weight of 0.5 to 50 g.

12. The golf club head according to claim 1, further comprising:

one or more screws attached to the side part, the screws being made of a material having specific gravity different from a specific gravity of a material of the side part.

13. The golf club head according to claim 1, wherein the sole part has rigidity greater than a rigidity of the crown part.

14. The golf club head according to claim 1, wherein the crown part and the side part are manufactured by a casting method.

15. The golf club head according to claim 1, wherein the face part includes:

a section having a maximum thickness at a center thereof; and an incline part which is formed outside the section having the maximum thickness and is gradually decreased.

16. The golf club head according to claim 1, wherein the face part is fixedly attached to a body of the head by plasma welding.

17. The golf club head according to claim 1, wherein the sole part comprises:

a face-side large-thickness sole part formed at a face side;

a back-side large-thickness sole part formed at a back side; and a small-thickness sole part which is formed adjacent to a back-side end of the face-side large-thickness sole part and has a thickness less than a thickness of the face-side large-thickness sole part;

wherein a length of the face-side large-thickness sole part in the face to back direction is 4% to 30% of a length of the sole part in the face to back direction;

wherein a length of the back-side large-thickness sole part in the face to back direction is 4% to 66% of the length of the sole part in the face to back direction; and wherein a length of the small-thickness sole part in the face to back direction is 4% to 92% of the length of the sole part in the face to back direction.

18. The golf club head according to claim 1, wherein the large-thickness crown part comprises:

a face-side large-thickness crown part; and a back-side large-thickness crown part.

19. The golf club head according to claim 1, wherein the large-thickness crown part is ring-shaped.

20. The golf club head according to claim 1, wherein a ratio of a rigidity of a face-side portion of the crown part to a rigidity of the side part is 1:1.

* * * * *